United States Patent [19]

Igielska

[11] Patent Number: 4,530,628

[45] Date of Patent: Jul. 23, 1985

[54] GUIDE SYSTEM FOR USE ON A SHIP

[75] Inventor: Jadwiga Igielska, Lerum, Sweden

[73] Assignee: Transconsultants AB, Gothenburg, Sweden

[21] Appl. No.: 558,521

[22] Filed: Dec. 6, 1983

[30] Foreign Application Priority Data

Oct. 18, 1983 [SE] Sweden ..... 8305726

[51] Int. Cl.[3] ..... B61D 45/00

[52] U.S. Cl. ..... 410/40; 114/75

[58] Field of Search ..... 114/72, 75, 180, 201 R, 114/203; 410/32, 39, 40, 38, 122-124; 206/512; 220/23.2, 23.4, 23.6; 414/137, 139

[56] References Cited

U.S. PATENT DOCUMENTS 3,481,298 12/1969 Dluhy ..... 114/72
3,921,538 11/1975 Bundy ..... 410/40
3,955,676 5/1976 Hansen ..... 410/40

FOREIGN PATENT DOCUMENTS 52-20584 2/1977 Japan ..... 114/75

*Primary Examiner*—Jesus D. Sotelo
*Attorney, Agent, or Firm*—Holman & Stern

[57] ABSTRACT

An arrangement for handling pontoon hatch covers on the deck of a ship equipped with a guide system for containers comprises guides that are positionable to positions inside and outside, respectively, the margin of at least one opening in the deck closeable by a pontoon hatch cover.

6 Claims, 8 Drawing Figures

FIG. 7
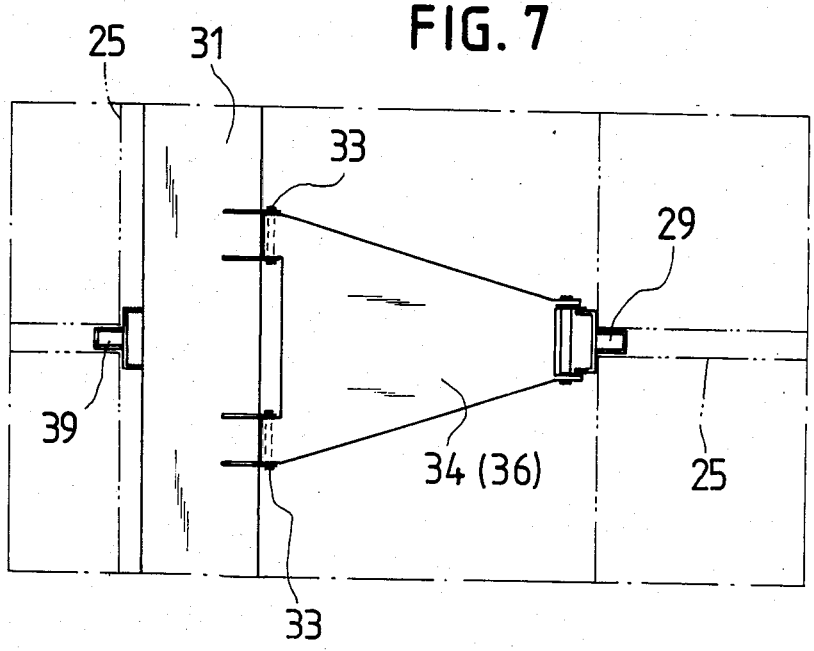
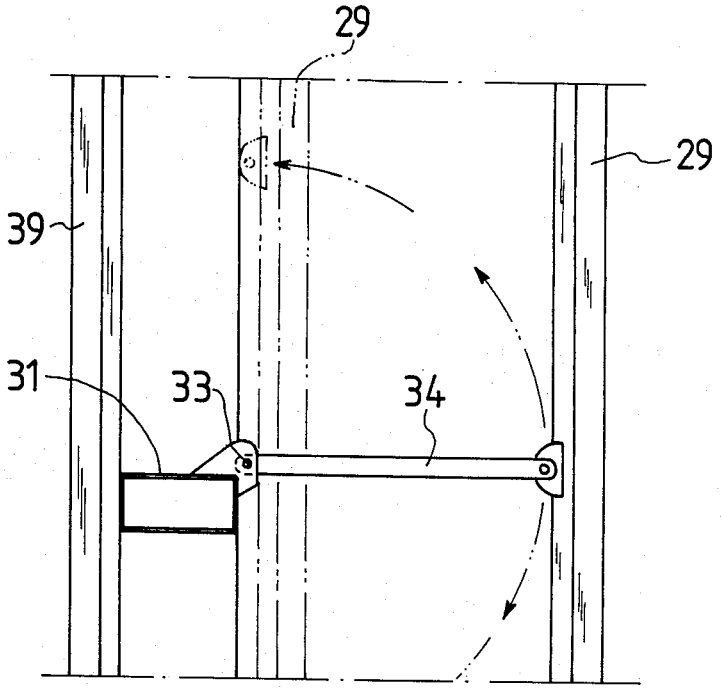
FIG. 8

GUIDE SYSTEM FOR USE ON A SHIP

BACKGROUND OF THE INVENTION

1. Field of the Invention

The present invention relates to ships provided with so called pontoon hatch covers. More precisely, the invention relates to ships which at least partially are arranged for transporting groups of unitary objects, for example containers, on at least one deck, for example the weather deck, and where the deck is provided with a guide system for said objects.

2. Description of the Prior Art

The problem behind the invention is to realize a handling system for pontoon hatch covers on a deck of the type mentioned. As is well known, pontoon hatch covers are operated by a crane and are lifted/lowered in position vertically from/onto a coaming, forming a margin of an opening in the deck. When the space below deck has been stowed and the hatch covers closed, the hatch covers are used as cargo stowage area on the deck.

Guide systems are the most efficient means for a container securing system but previously, there has not existed any proven guide system for cargo stowed onto a deck equipped with pontoon hatch covers. Taking into consideration the need for guides also under deck, the internal dimensions of a "cell" of such a guide system necessarily have to be less than the dimensions of an opening in the deck surrounded by the coaming.

A pontoon hatch cover dimensioned for being placed onto the coaming will have a size larger than the dimensions of the guide system below and above hatches. This means difficult handling of pontoon hatch covers especially when a shore crane has to be used.

The fact that pontoon hatch covers possess certain advantages means that there is a need for obviating the above problem and to offer a useful solution.

SUMMARY OF THE INVENTION

The invention in the broadest sense thereof, provides a ship comprising an arrangement for handling of groups of unitary objects, such as containers, where the ship, on at least one deck, for example the weather deck, is provided with a guide system for said objects and equipped with pontoon hatch covers.

The arrangement is such that the guide system comprises guides that are positionable in positions inside of and outside of, respectively, the margin of at least one opening in the deck closeable by a pontoon hatch cover.

In the first alternative the guide system is supported by a frame-work attached to the deck (hull) of the ship.

In this alternative at least the guides arranged for acting on one and the same side of a pile of objects are positionable from a first vertical position inside the margin to a second vertical position outside the margin.

Preferably, each one of the positionable guides is attached to an arm swingable around at least two horizontal, vertically spaced axes.

Suitably, the axes are arranged in the same vertical plane on the frame and such that the vertical plane intersects the deck at a sufficient distance from the margin for lifting the pontoon hatch cover vertically out from the guides system, if necessary combined with some horizontal movement before the hatch cover is lifted between the guides.

In the second alternative of the invention, a horizontally displaceable guide system is built as a "gable end" structure or as a module device. The "gable end" structure is built as a frame horizontally displaceable along the deck of a ship. The "gable end" structure comprises positionable and/or fixed guides at least on one side of the frame.

The module referred to is selfsustained, generally independent upon a ship hull structure.

The module is built as a framework fitted with displacing, positioning and locking devices, so that its position along the ship can be easily changed by shifting forward or aft.

The module comprises internal and/or external guides, at least one pair of internal guides being positionable from a first vertical position inside the margin to a second vertical position outside the margin.

Preferably, also the pair of external guides at the opposite side of the module device are positionable from a third vertical position inside the margin of an adjacent deck opening to a fourth vertical position outside the margin of said deck opening.

Each one of the positionable guides preferably is attached to an arm swingable around at least two horizontal, vertically spaced axes.

Suitably, the axes are arranged on said module in such a way that the positionable guides when they are in retracted place, together with a horizontal movement of the module, intersect the deck at a sufficient distance from the margin (s) for lifting the hatch cover.

BRIEF DESCRIPTION OF THE DRAWINGS

The invention will now be described in detail with reference to the accompanying drawings wherein:

FIG. 7 is a more detailed plan view showing the horizontal axis of rotation of a positionable guide;

FIG. 8 shows in a side view the guide in FIG. 7.

DESCRIPTION OF PREFERRED EMBODIMENTS

A number of loading/unloading openings in the deck of a ship have coamings 10 and are covered by pontoon hatch covers 11.

Figure 1:
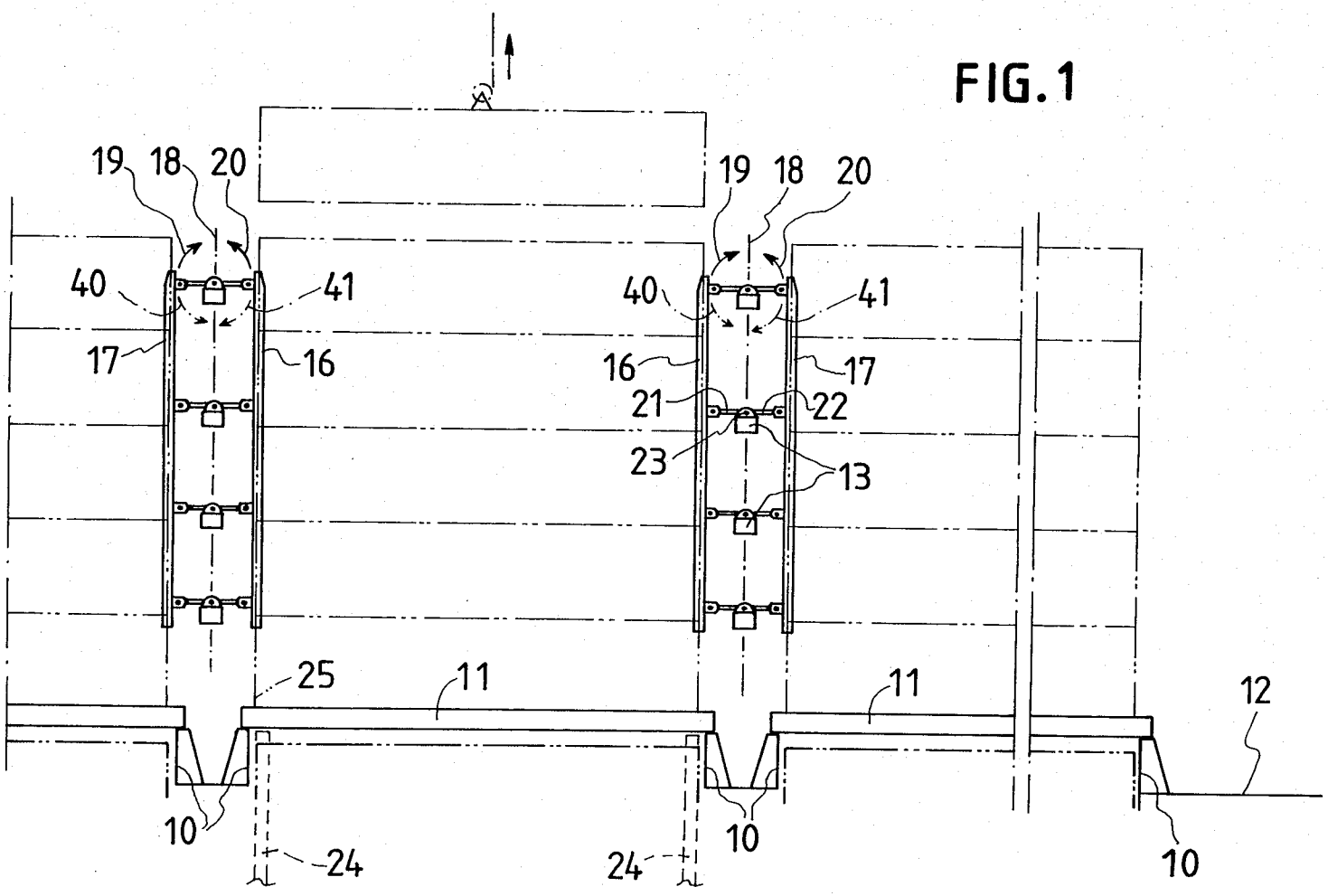
FIG. 1 in a broken, schematic side view shows the deck of a ship in the longitudinal direction, provided with a guide system according to a first embodiment of the invention, FIG. 2 in a broken, schematic side view shows the deck of a ship in the longitudinal direction, provided with a guide system built as a module device according to a second embodiment.

In the embodiment according to FIG. 1 there is a frame 13 comprising transverse beams fixedly attached onto the deck 12. The frame supports guide elements 16, 17 on both sides of a center plane 18 of two adjacent coamings 10. The guides 16, 17 are displaceable, each one as an integral unit, by swingable arms 21, 22 in the direction of the arrows 19 and 20 (or 40 and 41), respectively. Arms 21 and 22, to which positionable guides 16 and 17 are attached, are fitted on the axis of rotation 23 and supported by the frame 13.

In the position shown in FIG. 1, the guides 16 and 17 are located inside the coaming 10 of the opening covered by the hatch cover 11, and have a first vertical orientation allowing a direct lowering of a pile of containers onto the hatch cover 11.

By retracting the guides 16, 17 in the direction of the arrows 19 and 20 (or 40 and 41), for instance hydraulically, the guides come close to the frame 13 and offer internal dimensions allowing a vertical movement of the hatch cover (covers) 11.

Figure 2:
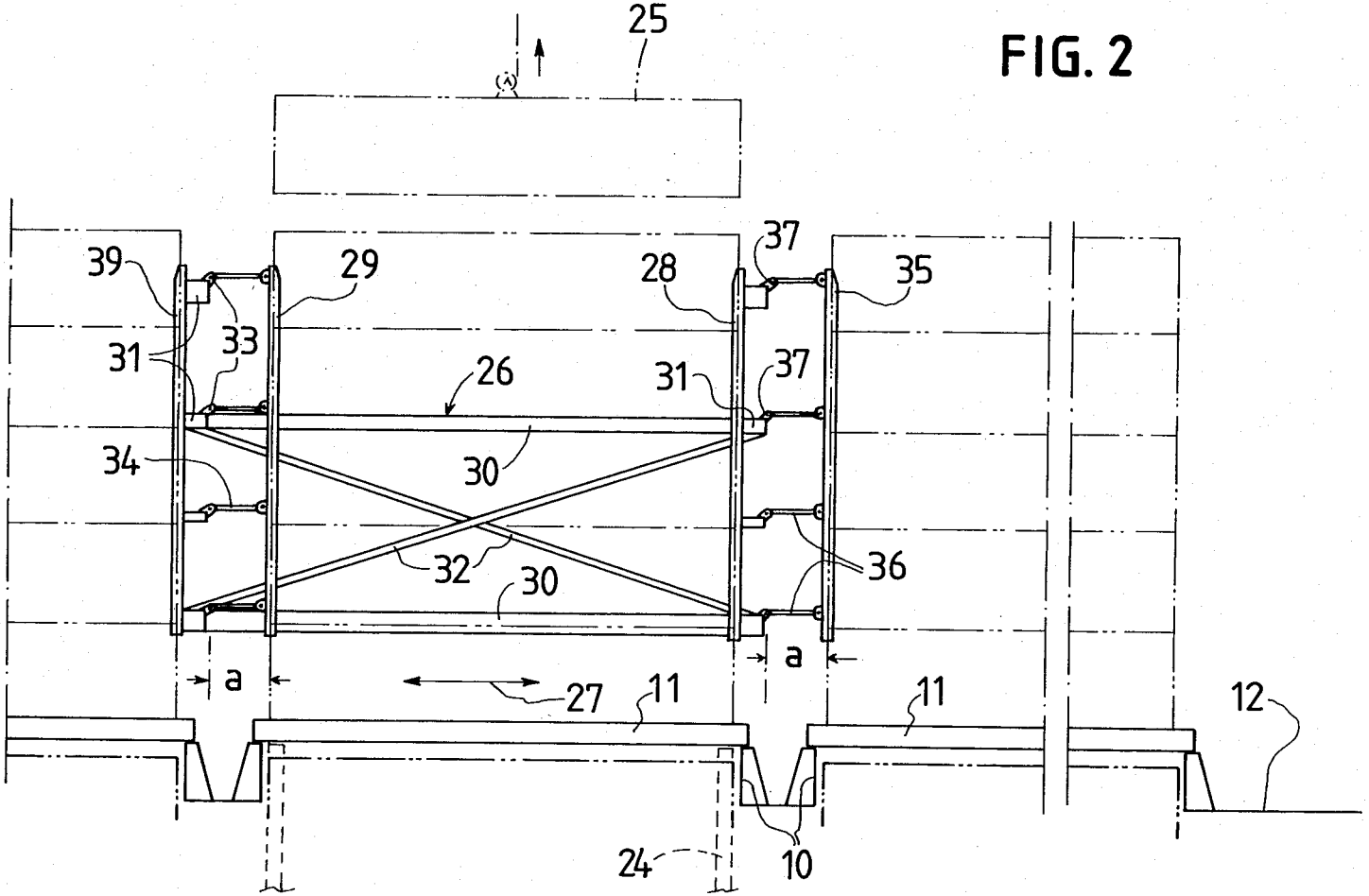

In FIG. 2 there is arranged a module 26 that is horizontally displaceable on the deck 12 of the ship.

In the same manner as previously, the hatch covers 11 cover openings in the deck 12 of the ship having coamings 10. The module (modules) are displaceable (for instance on rails) in the direction of the double arrows 27.

Each module comprises a pair of fixed internal guides 28 at one end thereof and a pair of positionable internal guides 29 at the opposite end. The module is constructed as a self-sustained unit comprising a longitudinal framing 30 and girders 32.

The internal dimensions determined by guides 28 and 29 correspond to the external dimensions of a container 25. The positions of the pair of guides in FIG. 2 correspond to loading/unloading position and transport position of containers on deck 12.

As the pontoon hatch cover 11 has to cover an opening of a larger dimension than the internal dimensions of the guide system 28, 29, the internal dimension of the guide system 28, 29 is adjustable. The pair of positionable guides 29 is attached to swingable arms 34 with axles 33 supported by the frame 31. Axes of rotation are provided on both ends of a swingable arm 34.

Each pair of internal guides is arranged opposite to an external pair of guides.

The adjustable pair of guides 29 is arranged opposite to an external pair of guides 39. Correspondingly, the fixed pair of guides 28 has an external pair of guides 35. Each guide 35 is arranged on joint arms 36 swingable around horizontal axes 37. The dimensions, between internal guides as well as external, are adapted to the actual container size.

Figure 3:
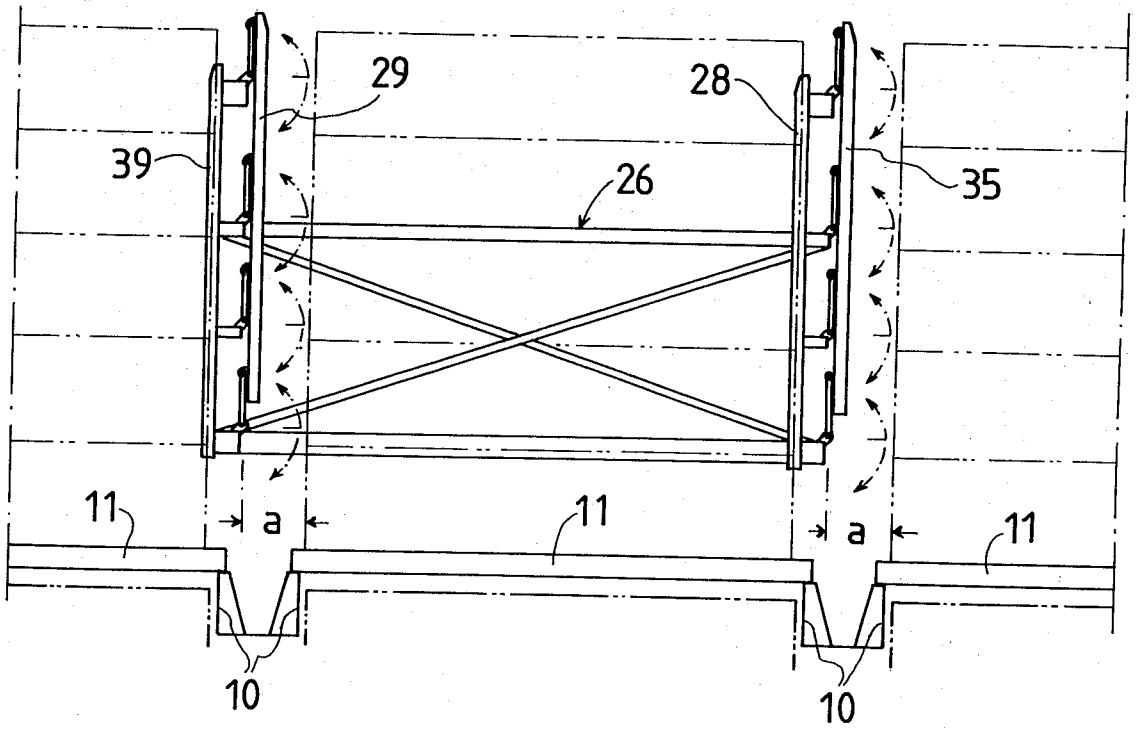
FIG. 3 shows the guide system with positionable guides according to FIG. 2 in retracted positions.

The joint arms 34, 36 are positionable into a vertical position up or down (FIG. 3), for instance hydraulically, and thereby offer a re-positioning to a second vertical position of the guide pair 29 and 35, respectively. The internal length of the module 26 thereby increases by the distance "a" and the external length of the module is decreased by the distance "a".

Figure 4:
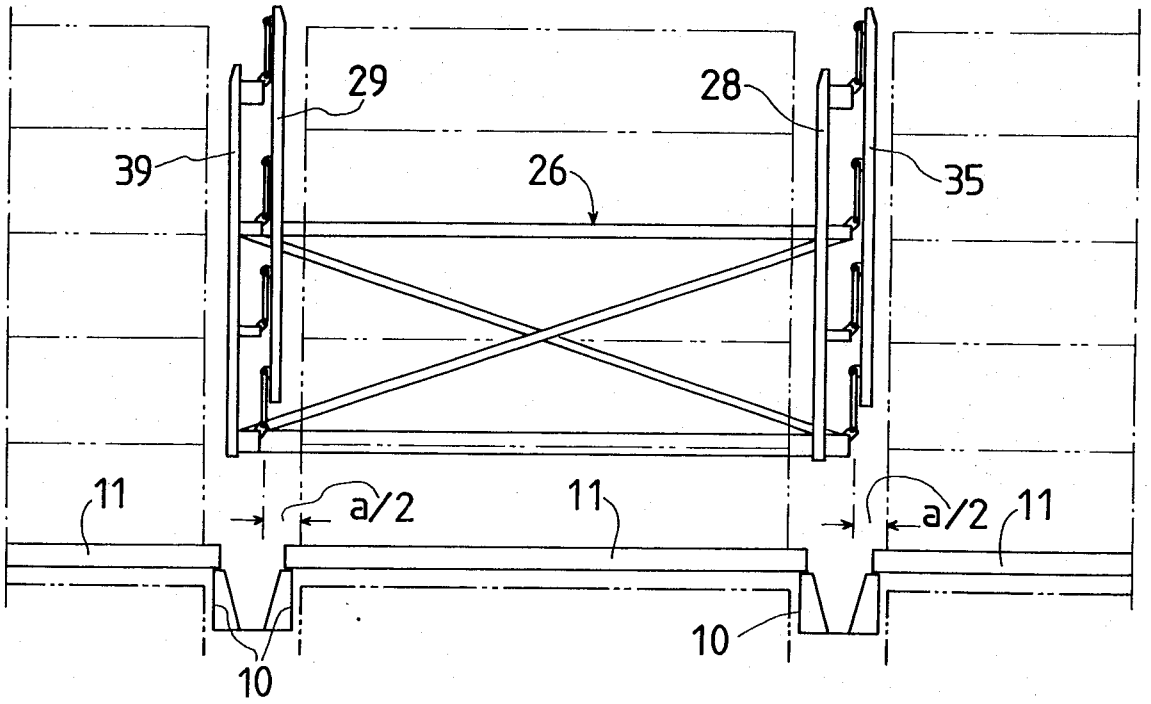
FIG. 4 shows guides and the module device of FIG. 3 in a longitudinally displaced position relative thereto.

As mentioned, the module 26 is displaceable in the horizontal direction. The movement for instance is carried out such that a distance "a/2" is obtained at both sides of the module. Such a position is shown in FIG. 4.

Figure 5:
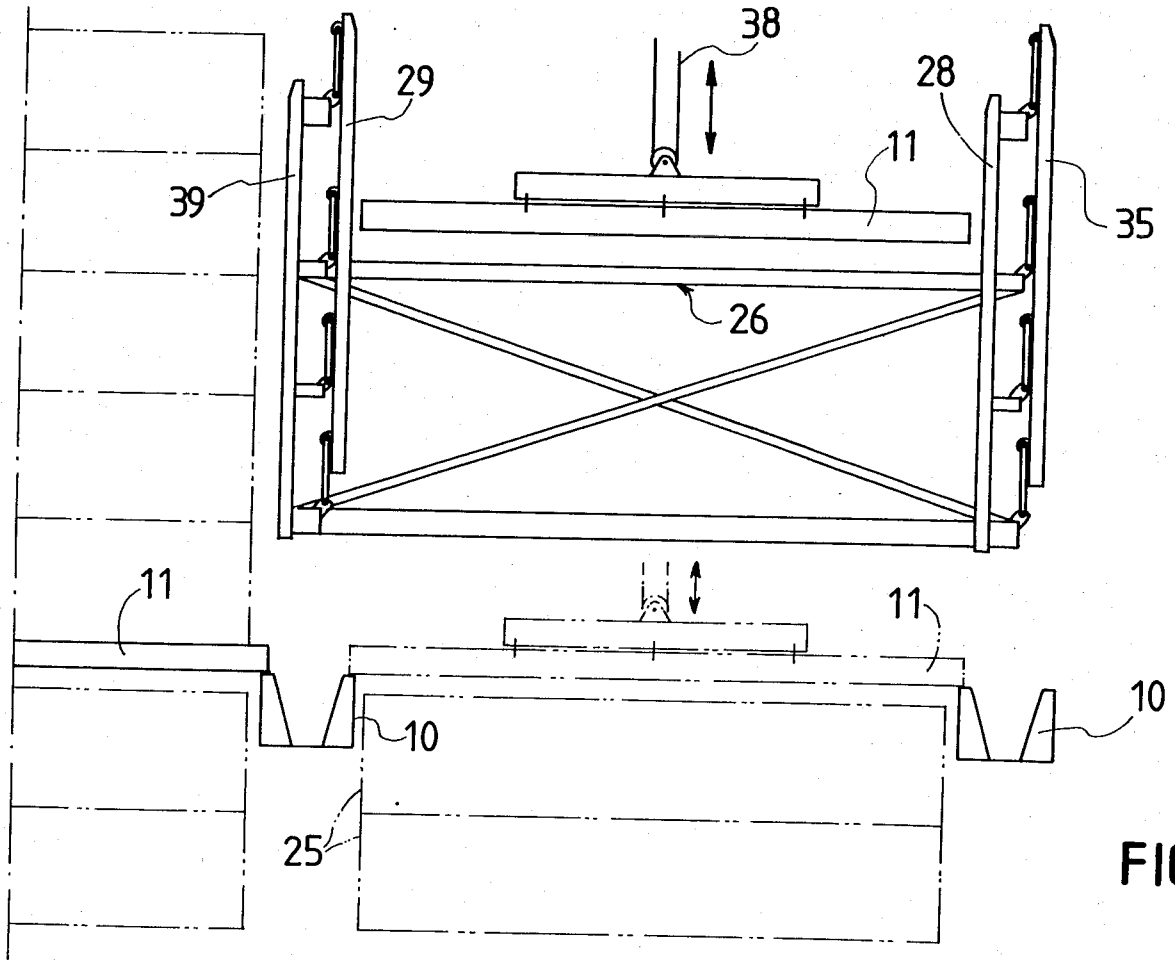
FIG. 5 schematically shows the operation of a pontoon hatch cover inside a module.

In the module position as in FIG. 5 the hatch cover 11 can be lifted up through the module by a crane 38.

Figure 6:
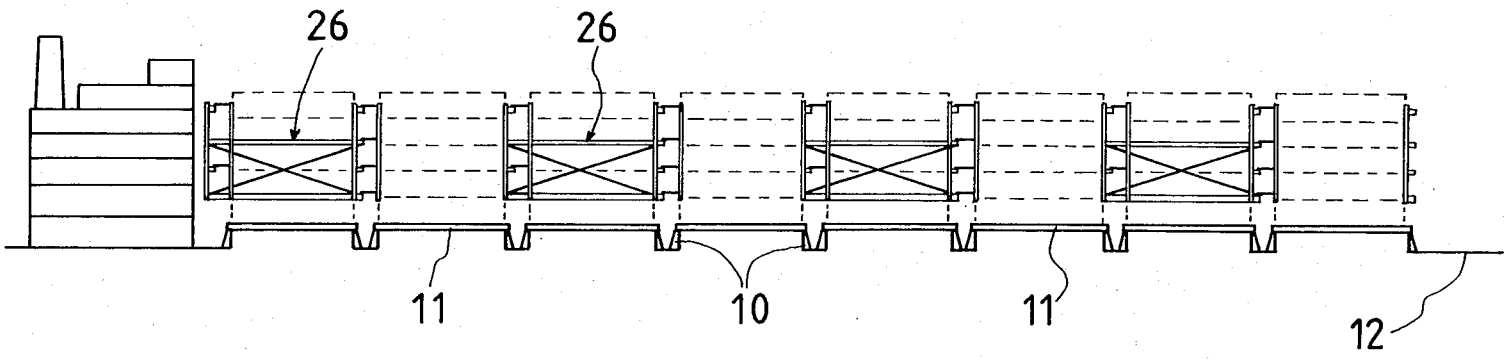
FIG. 6 in a longitudinal partial view shows on the deck of a ship a set of modules having positionable guides.

In FIG. 6 there is shown a set of modules 26 on a deck 12 of a ship. The modules are positionable in optimum transport position and are placed above each second hatch cover 11 in the manner shown.

FIGS. 7 and 8 more in detail show the joint arms 34 (36) and the attachment of such arms to horizontal axles 33.

We claim:

1. In a ship having an arrangement for handling groups of unitary objects such as containers on at least one deck, such as a weather deck, equipped with pontoon hatch covers for closing openings in the deck, a guide system comprising:

a module device horizontally displaceable on the deck of the ship; and at least one pair of internal and one pair of external guides supported by said module device so that at least said one pair of internal guides is positionable from a first vertical position inside the margin of at least one opening in the deck closeable by a pontoon hatch cover to a second vertical position outside said margin.

2. A guide system as claimed in claim 1 wherein: at least one pair of external guides is disposed at the opposite side of said module device from said positionable internal guides, and is positionable from a third vertical position inside the margin of an adjacent opening in the deck to a fourth vertical position outside said margin of said adjacent deck opening.

3. A guide system as claimed in claim 2 wherein:

each pair of positionable guides is supported on said module device by arms pivotably mounted for pivotable movement about at least two horizontal, vertically spaced axes of rotation.

4. A guide system as claimed in claim 3 wherein:

said axes of rotation are engaged on said module device so that there is sufficient distance for lifting a pontoon hatch cover vertically out through the guide system when said module device is moved a predetermined distance horizontally and said positionable guides are in said second vertical position.

5. A guide system as claimed in claim 1 wherein:

said positionable guides are supported on said module device by arms pivotally mounted for pivotable movement about at least two horizontal, vertically spaced axes of rotation.

6. A guide system as claimed in claim 5 wherein:

said axes of rotation are engaged on said module device so that there is sufficient distance for lifting a pontoon hatch cover vertically out through the guide system when said module device is moved a predetermined distance horizontally and said positionable guides are in said second vertical position.

* * * * *